US011352781B2

(12) United States Patent
Wu et al.

(10) Patent No.: US 11,352,781 B2
(45) Date of Patent: Jun. 7, 2022

(54) REVERSIBLE SELF-LOCKING INTERCONNECTION SYSTEM FOR MODULAR INTEGRATED CONSTRUCTION

(71) Applicant: Nano and Advanced Materials Institute Limited, Hong Kong (HK)

(72) Inventors: Yanmin Wu, Hong Kong (HK); Juan Zhang, Hong Kong (HK); Yik Fung Lau, Hong Kong (HK); Honggang Zhu, Hong Kong (HK)

(73) Assignee: Nano and Advanced Materials Institute Limited, Hong Kong (HK)

( * ) Notice: Subject to any disclaimer, the term of this patent is extended or adjusted under 35 U.S.C. 154(b) by 0 days.

(21) Appl. No.: 17/128,184

(22) Filed: Dec. 20, 2020

(65) Prior Publication Data

US 2022/0081895 A1 Mar. 17, 2022

Related U.S. Application Data

(60) Provisional application No. 63/078,349, filed on Sep. 15, 2020.

(51) Int. Cl.
*E04H 1/00* (2006.01)
*E04B 1/58* (2006.01)
(Continued)

(52) U.S. Cl.
CPC ..... *E04B 1/5831* (2013.01); *E04B 1/3483* (2013.01); *E04B 1/40* (2013.01); *E04B 2001/405* (2013.01); *E04B 2001/5856* (2013.01)

(58) Field of Classification Search
CPC ..... E04B 1/5831; E04B 1/3483; E04B 1/40
See application file for complete search history.

(56) References Cited

U.S. PATENT DOCUMENTS 3,537,736 A * 11/1970 Kroopp ..... E04B 1/5831 403/171
3,717,964 A * 2/1973 Brown ..... E04B 2/767 52/79.1

(Continued)

FOREIGN PATENT DOCUMENTS

CN 206345469 U 7/2017
CN 111287331 A 6/2020

(Continued)

OTHER PUBLICATIONS

Search Report of corresponding Hong Kong Short-Term Patent Application No. 32020022687.8 dated Jan. 22, 2021.

*Primary Examiner* — Basil S Katcheves
(74) *Attorney, Agent, or Firm* — Idea Intellectual Limited; Margaret A. Burke; Sam T. Yip

(57) ABSTRACT

A self-locking connection system for modular construction (e.g., MiC and PPVC) is provided for interlocking an upper module column to a lower module column. A horizontal load transfer plate has first and second inner sleeve portions positioned beneath and above the plate. The sleeves are configured and dimensioned to be received within the respective module columns. Spring-loaded latches in both sleeve portions engage respective column receiving apertures. Each latch may include a latch plate having a wedge-shaped latch protrusion connecting to a vertical latch surface. The latch plate has one or more latch plate apertures for receiving a rod within a coil spring. An optional second reversible self-locking mechanism interlocks the connected modules to a building load-bearing support such as a core wall. The second self-locking mechanism includes an angled protrusion extending from the horizontal load transfer plate to mate with a protrusion-receiving structure embedded in the load-bearing support.

8 Claims, 11 Drawing Sheets

(51) Int. Cl.

| | |
|---|---|
| ***E04B 1/348*** | (2006.01) |
| ***E04B 1/41*** | (2006.01) |
| *E04B 1/38* | (2006.01) |

(56) References Cited

U.S. PATENT DOCUMENTS

| | | | | |
|---|---|---|---|---|
| 5,590,974 | A * | 1/1997 | Yang | A47B 47/005 403/171 |
| 6,378,349 | B1 | 4/2002 | Waldrop | |
| 10,202,766 | B1 * | 2/2019 | Fox | E04B 7/045 |
| 2002/0037195 | A1 * | 3/2002 | Ajiki | F16B 7/187 403/403 |
| 2005/0084324 | A1 * | 4/2005 | Dubensky | E04H 5/02 403/305 |
| 2010/0014912 | A1 * | 1/2010 | Keyvanloo | F16B 12/40 403/354 |
| 2016/0060861 | A1 * | 3/2016 | Darden | E04H 3/24 52/111 |
| 2018/0135301 | A1 * | 5/2018 | Hasse | E04B 1/40 |
| 2018/0187407 | A1 * | 7/2018 | Mou | E04B 1/2403 |
| 2018/0274653 | A1 * | 9/2018 | Mueller | F16H 57/031 |
| 2018/0328051 | A1 * | 11/2018 | Singh | E04F 13/0733 |
| 2018/0363287 | A1 * | 12/2018 | Fox | E04B 1/5831 |
| 2019/0078321 | A1 * | 3/2019 | Bowron | E04G 21/142 |

FOREIGN PATENT DOCUMENTS

| | | | |
|---|---|---|---|
| CN | 111287332 | A | 6/2020 |
| CN | 111639371 | A | 9/2020 |
| JP | 2005291242 | A | 10/2005 |

* cited by examiner

REVERSIBLE SELF-LOCKING INTERCONNECTION SYSTEM FOR MODULAR INTEGRATED CONSTRUCTION

CROSS-REFERENCE TO RELATED APPLICATIONS

This application claims priority from U.S. provisional patent application Ser. No. 63/078,349 filed Sep. 15, 2020, and the disclosure of which is incorporated herein by reference in its entirety.

FIELD OF THE INVENTION

The invention relates to multistory buildings composed of prefabricated modules, such as Modular Integrated Construction (MIC) or Prefabricated Prefinished Volumetric Construction (PPVC) and, more particularly, to reversible, self-locking connections between columns or beams of adjacent modules that permit interconnection among plural modules with minimal worker interaction.

BACKGROUND

Construction of multistory buildings is an expensive and time-consuming process that involves considerable skilled labor and often dangerous working conditions. Due to adverse conditions at construction sites such as hot or cold weather, rain or snow, various finishing may take place in a poor environment, resulting in construction delays and defects in the finished product.

In order to improve building quality and acceleration construction time, modular techniques such as Modular Integrated Construction (MiC) or Prefabricated Prefinished Volumetric Construction (PPVC) are increasingly used. In these techniques, modules are created in a factory, with optional finished plumbing and electrical work. The prefabricated modules are delivered to the building site and assembled into multistory buildings. Each module may be a portion of an office, apartment, or flat, or may be a complete apartment. In some building designs, core walls are erected onsite, such as concrete core walls, and modules must be connected to the core walls as well as to each other.

Various techniques may be used to join modules together. For steel components, mechanical connections such as bolts or tension rods may be used; for example, a bolt inserted through a hole in one module may be inserted through a hold in a mating module. This requires considerable worker interaction to insert and tighten the bolt. In addition to connections between steel components such as steel beams and columns, connections between steel and concrete components are also needed such as connections between steel module components and concrete core walls.

Further, the connection between modules and concrete core walls may have issues with design tolerance. To ensure the strength and stiffness of MiC building systems, MiC connections are generally designed for small tolerance. However, the tolerance of on-site constructed core walls may be difficult to control. Consequently, it is difficult to create a module to core wall connection sufficient to satisfy the strength and stiffness on the one hand and allow larger tolerance on the other hand.

Thus, there is a need in the art for improved connections between modules and between modules are core building elements.

SUMMARY OF THE INVENTION

The present invention provides a novel connection system for modular construction such as MiC and PPVC construction. The novel connection system is self-locking, minimizing the need for worker interaction, and is reversible, such that constructed modules may optionally be disassembled and re-built at another location.

In a first aspect the present invention, there is provided a first lower steel module defining a portion of a modular building having plural lower module columns, at least a first lower module column including a first lower column receiving aperture. A first upper steel module defines a portion of a modular building having plural upper module columns, at least a first upper module column including a first upper column receiving aperture. A first reversible self-locking mechanism interlocks the first upper module column of the first upper steel module to the first lower module column of the first lower steel module. The first self-locking mechanism includes a horizontal load transfer plate for transferring loads in a horizontal direction. A first inner sleeve is positioned beneath and connected to the horizontal load transfer plate, the first inner sleeve configured and dimensioned to be received within the first lower module column. A second inner sleeve is positioned above and connected to the horizontal load transfer plate, the second inner sleeve configured and dimensioned to be received within the first upper module column. A first spring-loaded latch is positioned within the first inner sleeve for engaging the first lower column receiving aperture. A second spring-loaded latch is positioned within the second inner sleeve for engaging the first upper column receiving aperture. The first and second spring-loaded latches are recessed within the respective first and second inner sleeves during insertion of the first and second inner sleeves into the lower and upper module columns, the first and second latches engaging with the first and second receiving apertures by respective spring forces when the first upper steel module is positioned and aligned on the first lower steel module.

Each of the first and second spring-loaded latches may include a latch plate having a wedge-shaped latch protrusion connecting to a vertical latch surface. The latch plate may include one or more latch plate apertures for receiving a rod within a coil spring.

The reversible self-locking interconnection system may optionally include a second reversible self-locking mechanism interlocking the first upper steel module and the first lower steel module to a building load-bearing support such as a core wall or core beam or core column. The second reversible self-locking mechanism includes an angled protrusion extending from the horizontal load transfer plate to mate with a protrusion-receiving structure embedded in the load-bearing support. In one embodiment, the horizontal load-transfer plate may include a 90-degree angled edge/L-shaped plate that mates with the embedded protrusion-receiving structure. In another embodiment, the protrusion-receiving structure includes a base portion embedded in the load-bearing support and an adjustable cover plate forming a plate-receiving slot. In yet another embodiment, the load-bearing support is a core wall or a core column, or a core beam.

In other embodiment, the present system further comprises third and fourth steel modules, the third steel module positioned adjacent the first steel module and the fourth steel module positioned adjacent the second steel module, each of the third and fourth steel modules including columns with receiving apertures positioned therein, and wherein the first reversible self-locking mechanism includes third and fourth inner sleeves positioned adjacent to the first and second inner sleeves with third and fourth spring loaded latches positioned therein for engaging the receiving apertures such that the first reversible self-locking mechanism connects all of the first, second, third, and fourth steel modules.

In a second aspect of the present invention, there is provided a reversible self-locking interconnection system for modular integrated construction comprising:

first, second, third and fourth lower steel modules, each module defining a portion of a modular building having plural lower module columns, at least one of each lower steel module have a lower module column including a lower column receiving aperture;

first, second, third and fourth upper steel modules, each module defining a portion of a modular building having plural upper module columns, at least one of each upper steel module having an upper module column including an upper column receiving aperture;

a first reversible self-locking mechanism interlocking one upper module column of each of the first, second, third, and fourth upper steel modules to one lower module column of each of the first, second, third, and fourth lower steel modules, the first self-locking mechanism including:

a horizontal load transfer plate for transferring loads in a horizontal direction;

first, second, third, and fourth lower inner sleeves positioned beneath and connected to the horizontal load transfer plate, each lower inner sleeve configured and dimensioned to be received within one of a first, second, third, and fourth lower module columns;

first, second, third, and fourth upper inner sleeves positioned above and connected to the horizontal load transfer plate, the upper inner sleeves configured and dimensioned to be received within one of a first, second, third, and fourth upper module columns;

first spring-loaded latches positioned within each of the lower inner sleeves for engaging lower column receiving apertures;

second spring-loaded latches positioned within each of the upper inner sleeves for engaging upper column receiving apertures;

wherein the first and second spring-loaded latches are recessed within the respective inner sleeves during insertion of the inner sleeves into lower and upper module columns, the first and second latches engaging with the receiving apertures by respective spring forces when the upper steel modules are positioned and aligned on the lower steel modules.

A third aspect of the present invention provides a method for assembling a plurality of modules using the reversible self-locking interconnection system of the present invention, where the method comprises: positioning a lower steel module; inserting a sleeve assembly comprising an inner sleeve in the lower steel module such that the first latch is first depressed to be flush with the inner sleeve walls and, when the inner sleeve reaches the lower column aperture, projecting into the aperture through the action of springs against the latch plate, thereby securing the sleeve assembly to the lower module; positioning an upper module over the sleeve assembly secured to the corresponding lower module; and depressing the second latch until the second latch engages in the upper module column aperture of the upper module.

DETAILED DESCRIPTION

Figure 1:
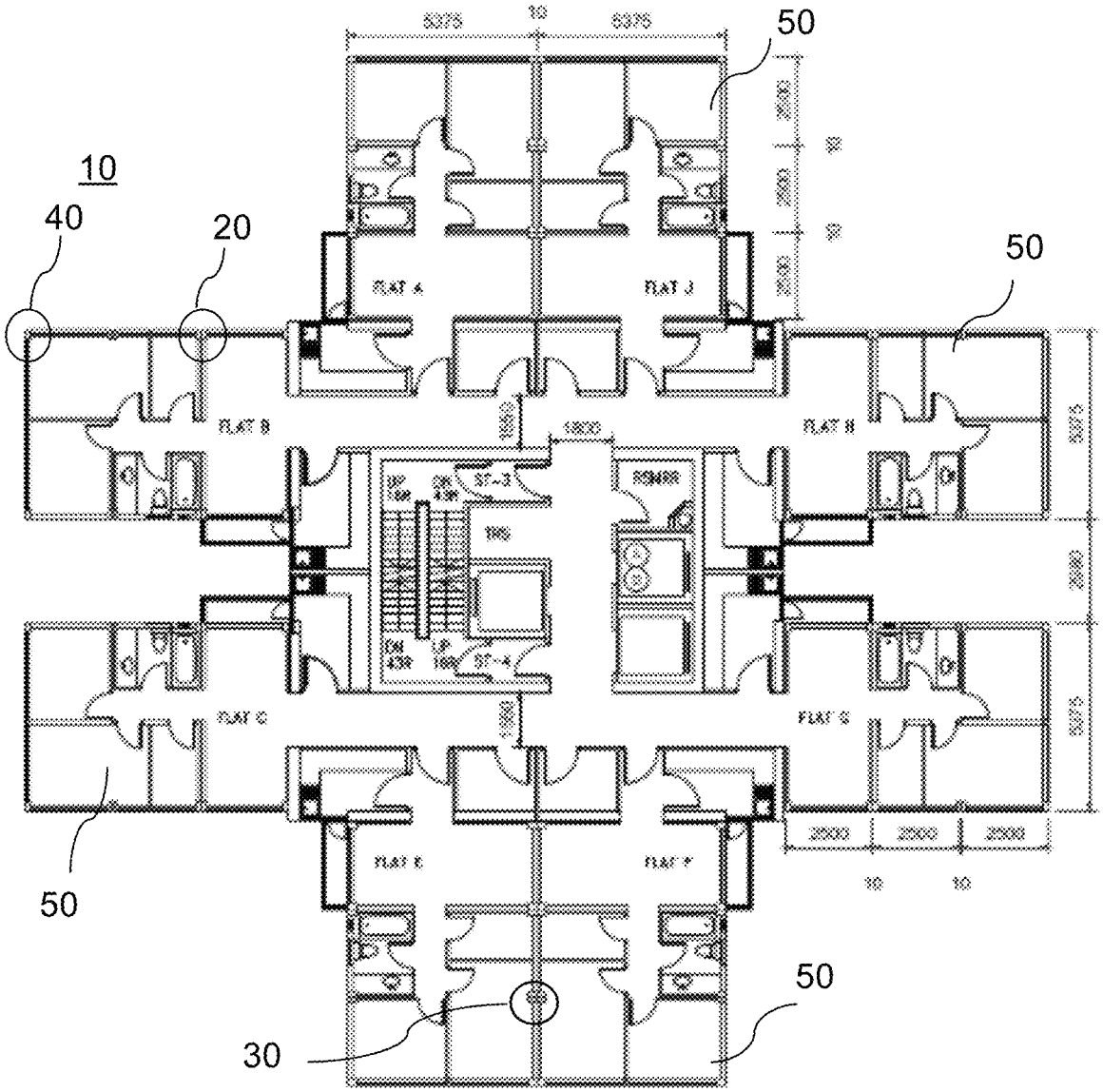
FIG. 1 is an example of a floor layout for a multistory building showing a combination of MiC modules with building core walls.

Turning to the drawings in detail, FIG. 1 depicts the floorplan 10 of a single story of a building that is made up of plural MiC modules 50. As seen in FIG. 1, multiple modules 50 may be used in order to construct a single dwelling unit within a multistory building. Alternatively, a single module 50 may be subdivided into plural rooms to form an apartment in the building. As seen in FIG. 1, various plumbing fixtures may be included in the module. Although not shown in any of the drawings, it is understood that each module may be completely finished with wall coverings, floor coverings, built-in cabinets and other finished. The modules may also be partly finished or unfinished, depending upon the desired application of the building. A number of different types of connections are used depending upon how many modules are to be joined together. At element 20, only two lower modules will be joined with two upper modules. At element 30, four lower modules will be joined with four upper modules. In the corner at element 40, only a single lower module will be connected to a single upper module. The connection system of the present invention accommodates any number of modules to be joined together.

Figure 2:
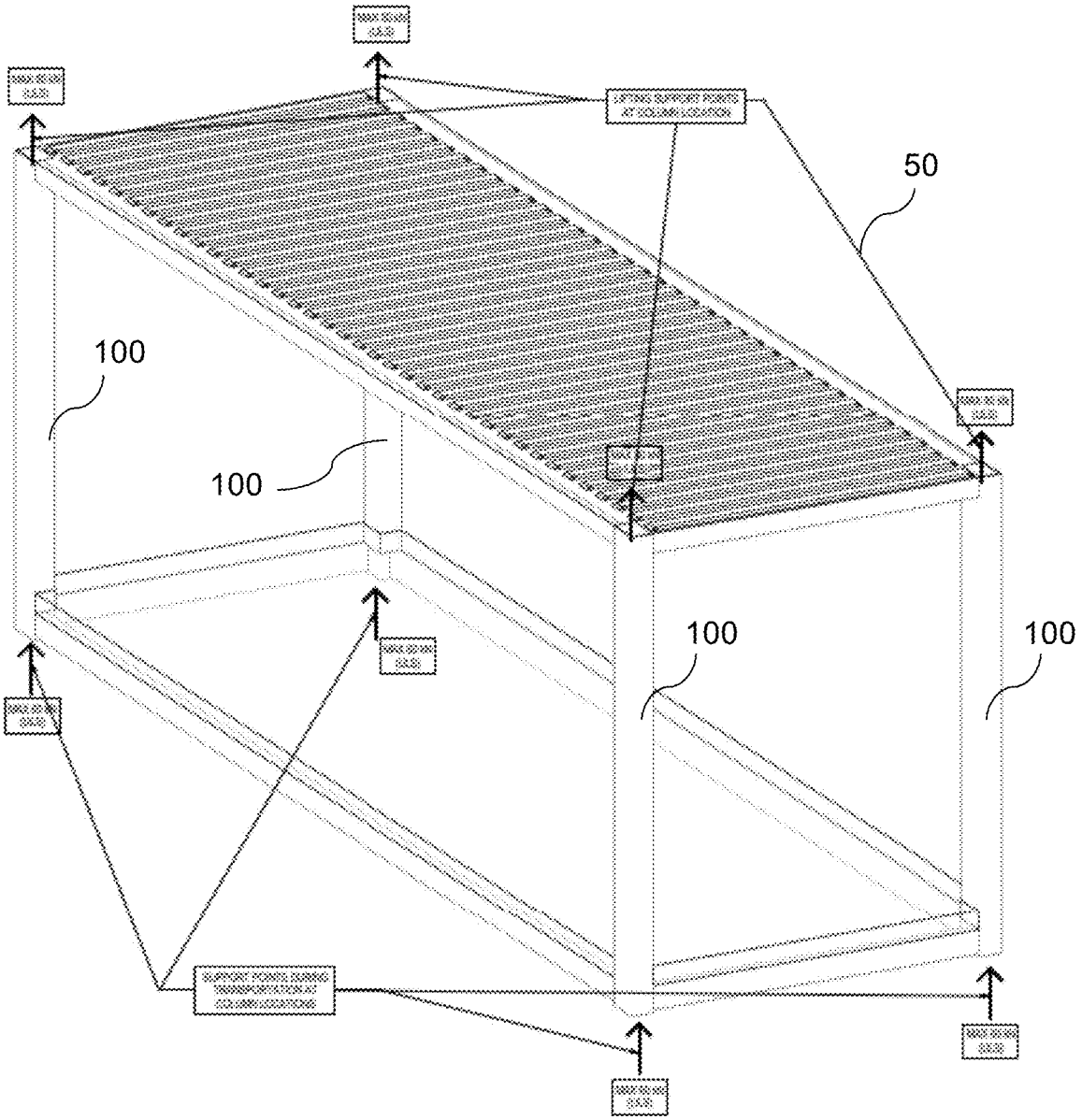
FIG. 2 is an embodiment of an MiC module with hollow section columns.

A schematic example of a module 50 is depicted in FIG. 2 showing only various structural elements without any interior finishes such as walls and floors. As seen in FIG. 2, four columns 100 are positioned at the four corners of module 50. The arrows depict points for lifting the module by a crane to position the module within a building under construction. As seen in FIG. 2, the columns 100 are hollow steel columns; however, solid columns with hollow regions near connection points may also be used in the present invention.

Figure 3A:
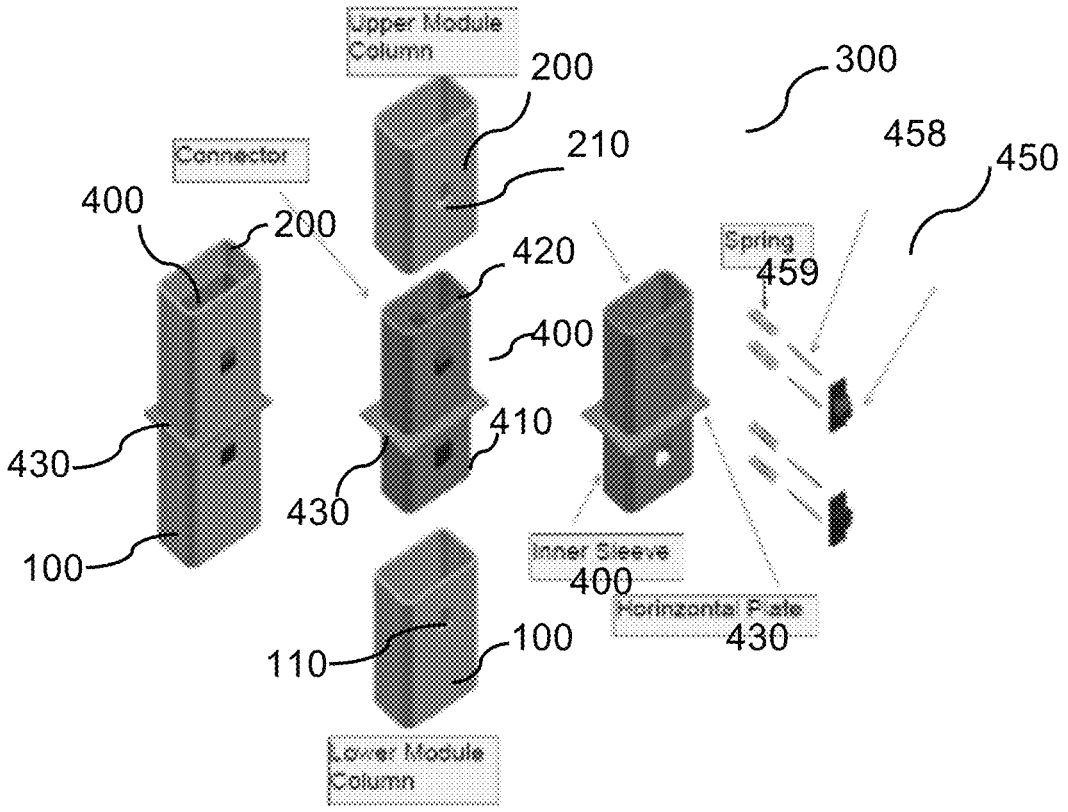
FIG. 3A is a perspective view of a connection system of the present invention.

FIG. 3A depicts a connection system 300 according to an aspect of the present invention. The connection system 300 connects a lower module column 100 to an upper module column 200. The connection system 300 includes an inner sleeve 400 that is dimensioned and configured to be received within ends of both the lower module column 100 and the upper module column 200. A horizontal load transfer plate 430 is positioned between a lower inner sleeve portion 410 and an upper inner sleeve portion 420. When used with multiple lower and multiple upper modules, the horizontal load transfer plate 430 transfers horizontal loading among the various modules, further strengthening the overall building structure.

A spring-loaded latch system 450 is included in both the lower inner sleeve portion 410 and upper inner sleeve portion 420. Latch system 450 engages receiving aperture 110 in the lower inner sleeve portion and receiving aperture 210 in the upper inner sleeve portion. A detailed depiction of spring-loaded latch system 450 is depicted in FIG. 3D. In FIG. 3D, latch system 450 includes a latch that includes latch elements 454 and 455 mounted on latch plate 456. The first latch element 454 is a wedge shaped element with a sloped surface that leads to second latch element 455 with a substantially planar surface. A pair of springs 459 encircles rod 458 that cooperates with apertures 457 on latch plate 456. In operation, the latch plate with latch elements 454 and 455 is recessed when springs 459 are compressed due to the action of either the upper module column 200 or the lower module column 100. During installation of the inner sleeve 400 within a lower module column 100, the latch wedge-shaped latch element 454 ensures a smooth insertion of the latch into the inner sleeve 400. When the latch elements 454 and 455 reach the lower module column aperture 110, the latch extends through the aperture under the action of spring 459 and the sleeve is securely engaged in the lower module column 100.

Similarly, when an upper module is hoisted into place above the lower module, the wedge shaped latch element 454 smoothly engages a leading edge of the upper module column 200 and the latch is gradually compressed to a recessed position within the upper module column 200 and the column edge moves up along the wedge-shaped element 454. When the latch reaches the upper module column aperture 210, the latch extends through the aperture due to the action of spring 459. In this manner the sleeve is securely engaged in both the lower and upper columns and the upper and lower modules are connected.

Note that the angle of the wedge is opposite in the upper and lower latch elements 454 to accommodate the insertion of the sleeve into the lower module column 100 and the placement of the upper module column 200 over the upper inner sleeve portion 420 (best seen in FIG. 3C, discussed below). In this manner, the wedge-shaped latch elements 454 are readily depressed by the respective actions of sleeve insertion and upper module placement.

Figure 3B:
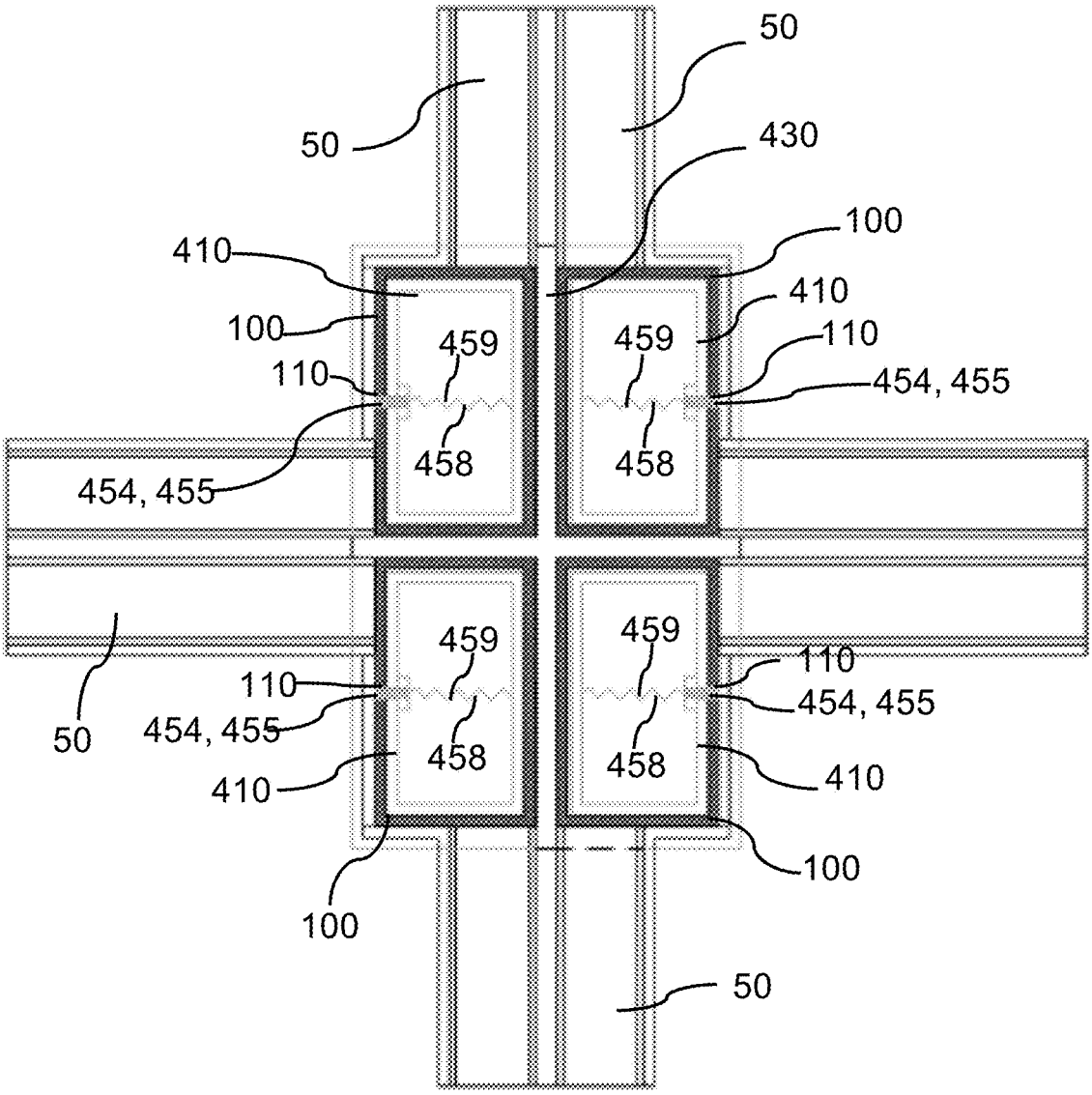
FIG. 3B is a top cross-sectional view of a four-module connection using the connection system of FIG. 3A.

FIG. 3B depicts an assembled system of FIG. 3A in a cross-sectional top view. As seen in FIG. 3B, four lower modules 50 are interconnected with a single horizontal load transfer plate 430 and four lower inner sleeve portions 410 positioned within lower module columns 100. In the connected position of FIG. 3B, the springs 459 have urged the latch portions 454 and 455 through the lower module column aperture 110. Note that a cross-sectional view taken through the upper module columns 200 would look substantially similar to the view of FIG. 3B.

Figure 3C:
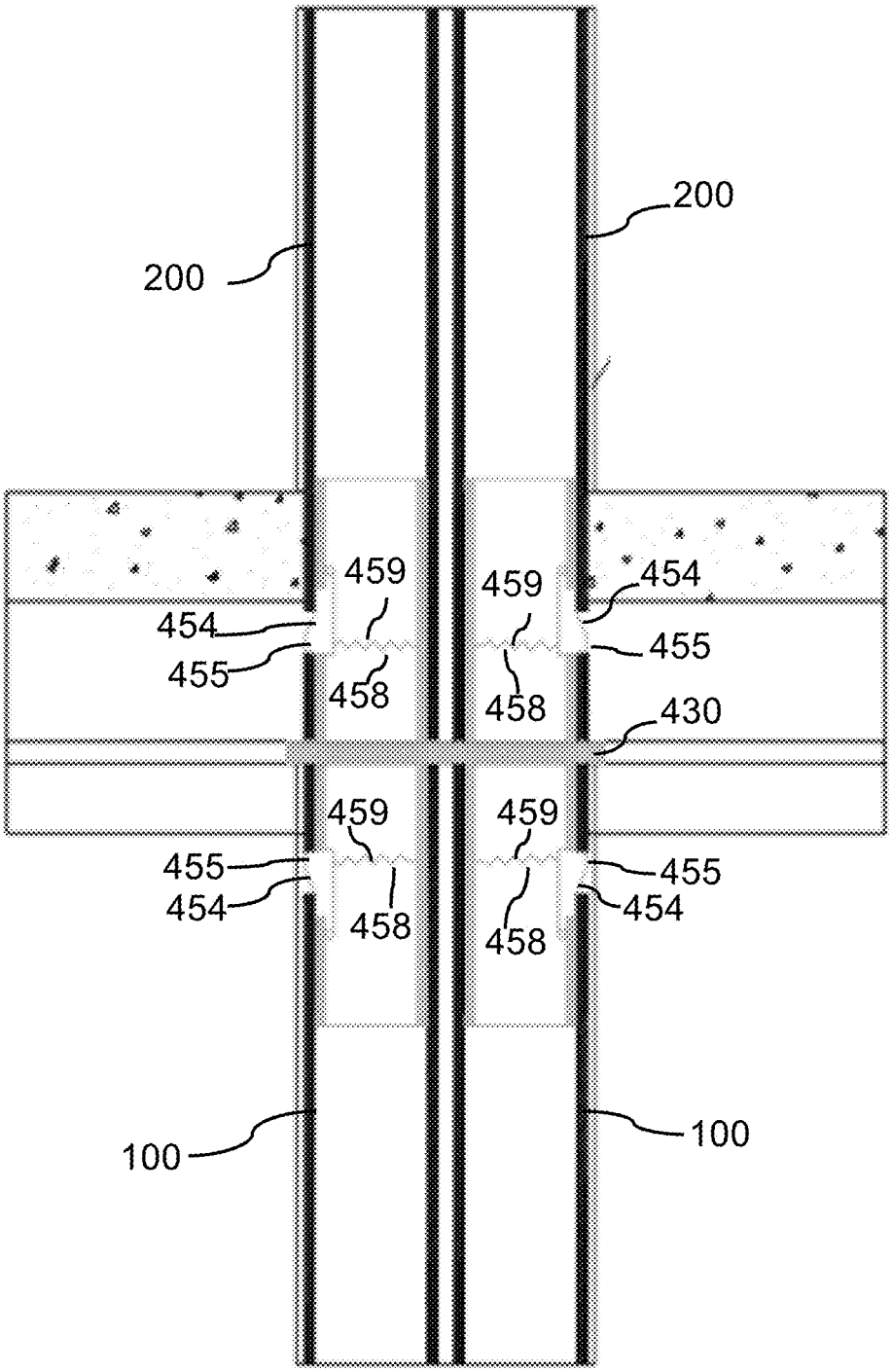
FIG. 3C is a side cross-sectional view of a four-module connection using the connection system of FIG. 3A.
Figure 3D:
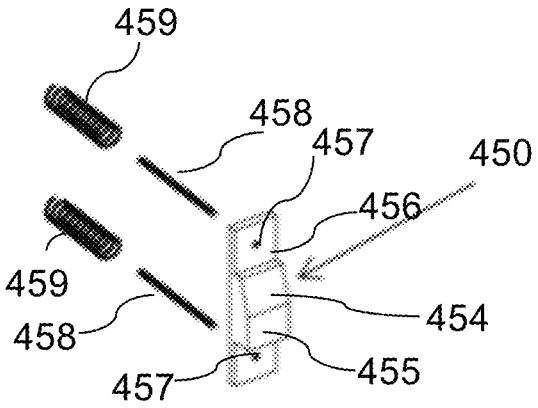
FIG. 3D is a perspective view of a spring-loaded latch system.

FIG. 3C depicts as assembled system of FIG. 3A in side cross sectional view showing two lower module columns 100 and two upper module columns 200. In this view the opposite orientation of wedge elements 454 and vertical elements 455 is clearly depicted. Further visible is this view is the horizontal load transfer plate 430 extending between plural lower modules and plural upper modules, forming a further load-sharing connection among modules.

Figure 4A:
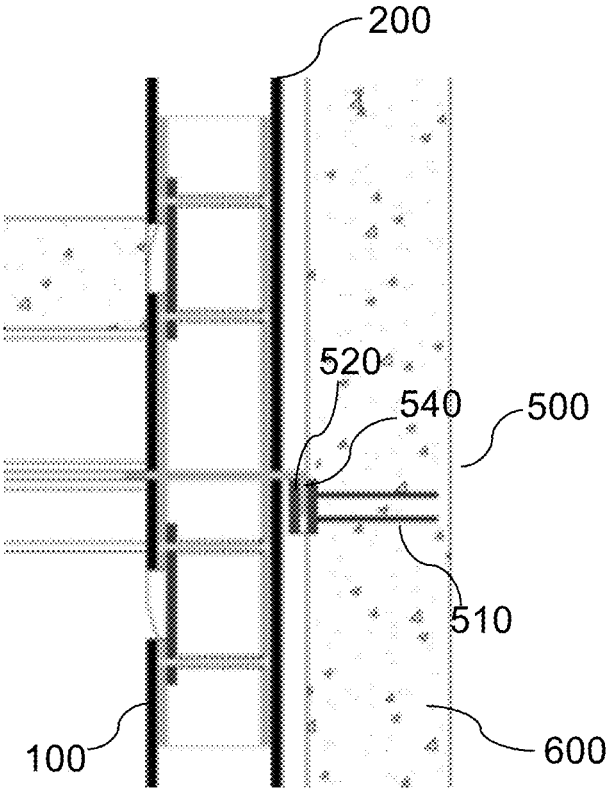
FIG. 4A is a side view in cross-section of a further aspect of a connection system for attachment to a core structural element.
Figure 4B:
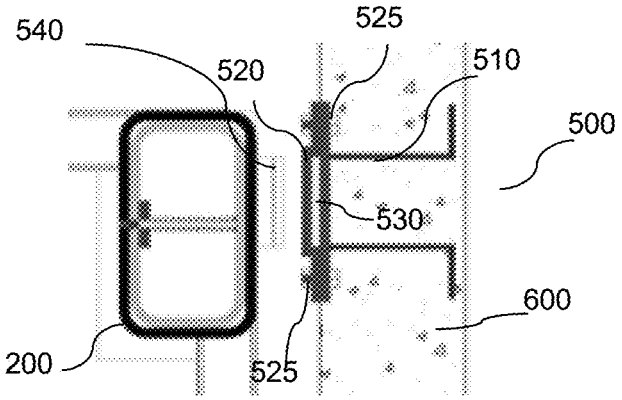
FIG. 4B is a top view of the construction of a core structural element depicting an embedded portion having an adjustable plate.
Figure 4C:
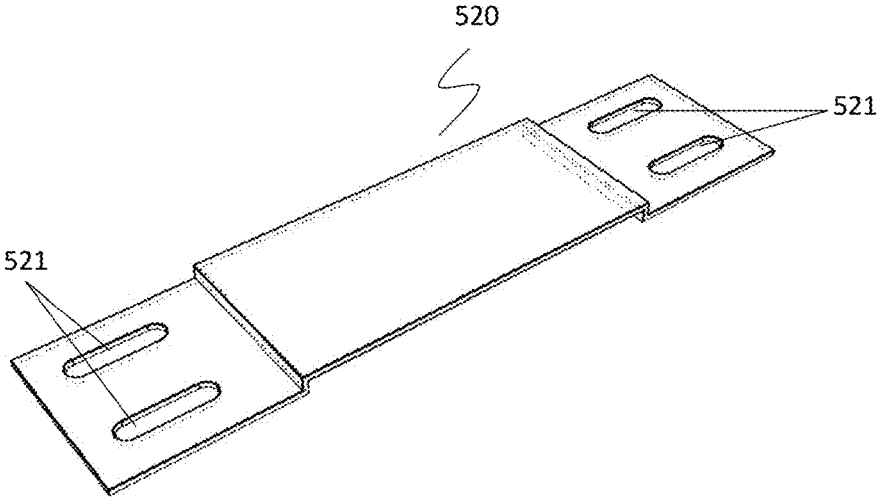
FIG. 4C is a perspective view of an adjustable cover plate.

In some embodiments, an optional second connection system may be used to connect an assembly of connected modules to a building load-bearing support such as a core wall, core column, or core beam. In many modular buildings, various core elements are erected onsite and form a building core to which plural modules are attached. In some embodiments, these core elements are fabricated from concrete such that different connection techniques may be needed to facilitate a steel-to-concrete connection. Further, as discussed above, the core building elements may not have as precise tolerances as the pre-fabricated modules. As such, the connection system must be able to accommodate dimensional variations. FIGS. 4A-4B depict the optional second connection system 500 while FIGS. 5A-5D depict column connection with the second connection system, according to a further aspect of the present invention. In the second connection system 500, a base connector 510 is embedded in the core structural element 600, best seen in FIG. 4B and; core structure element 600 is a concrete structure such as core wall in this embodiment. In order to compensate for variations in wall thickness, an adjustable cover plate 520 is attached to base connector 510 through fasteners 525 which may be bolts or other threaded or non-threaded fasteners. An example of the adjustable cover plate 520 is depicted in FIG. 4C, in which the cover plate 520 is provided with slotted bolt holes 521. By providing slotted bolt holes, the position of cover plate 520 could be adjusted to compensate the construction tolerance of load-bearing support during module installation. The exact number of slotted bolt holes vary according to the design requirements of each specific project. By adjusting the space between the cover plate 520 and the base connector 510, an adjustable aperture 530 is formed for receiving a projection from connection system 300 or from another connector. As seen in FIGS. 4A and 4B, a projection 540 extends from the connection system 300; in one embodiment, the projection 540 may be an angled plate extending from the horizontal load-sharing plate 430. The angle may be a 90 degree angle such that an "L-shaped" projection 540 is formed. This L-shaped projection may be inserted into the aperture 530 as the inner sleeve assembly is lowered into the lower module columns. In this manner, the inner sleeve is assembled to the lower modules at the same time that the lower modules are assembled to the core structural element 600.

Figure 5A:
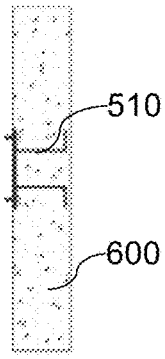
FIGS. 5A-5E depict an installation sequence using the connection system of FIGS. 4A-4B to connect upper and lower modules to a core wall.
Figure 5B:
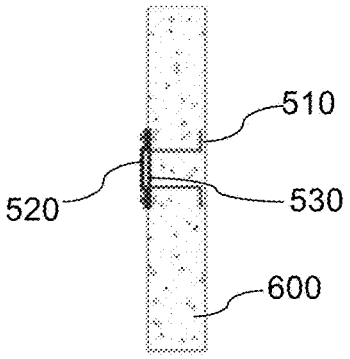
Figure 5C:
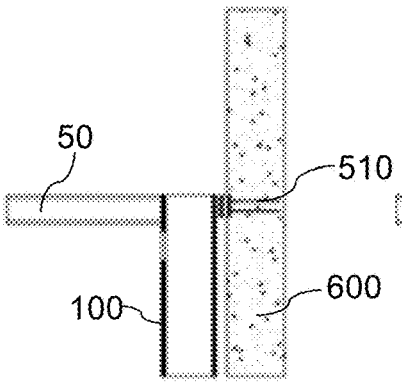
Figure 5D:
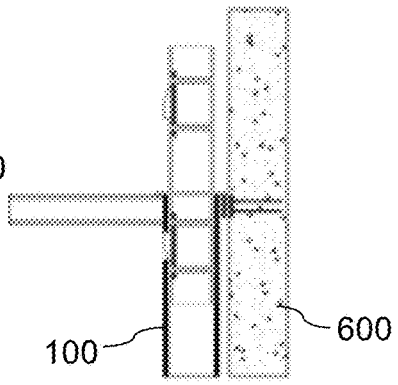
Figure 5E:
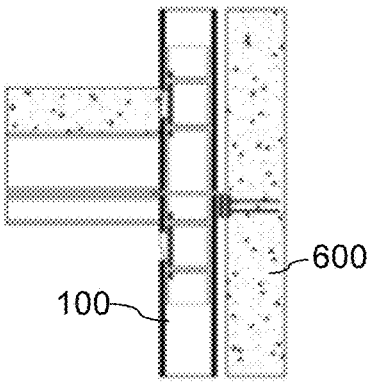

In FIG. 5A, the core structural element 600 is provided with the base connector 510 embedded therein. In FIG. 5B, the adjustable cover plate 520 has been added, forming the aperture 530. In FIG. 5C, the lower module 50 with lower module column 100 has been hoisted into position adjacent to the core structural element 600. In FIG. 5D an inner sleeve assembly 400 has been inserted into the lower module column 100 such that the latch is engaged in the column aperture. Simultaneously, the L-shaped projection 540 extending from horizontal plate 430 is inserted into the aperture 530. Following the insertion of the inner sleeve assembly 400, a second, upper module is assembled over the inner sleeve, FIG. 5E, and securely connected to the lower module through the inner sleeve assembly via the latches in the upper and lower inner sleeve portions.

Figure 6A:
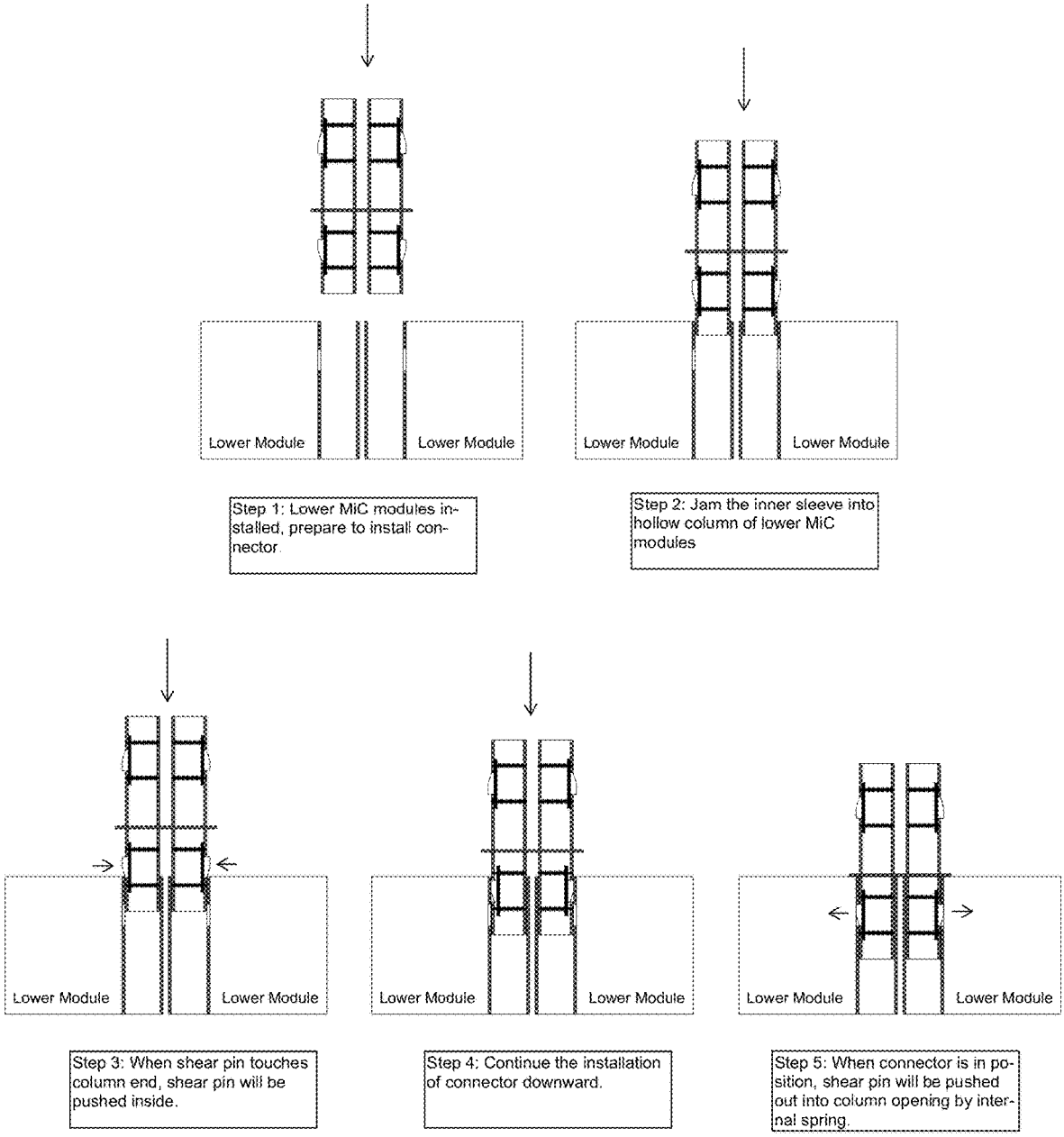
FIGS. 6A-6B depict an installation sequence for connecting four modules: two lower modules and two upper modules using the connection system of FIGS. 3A-3C.
Figure 6B:
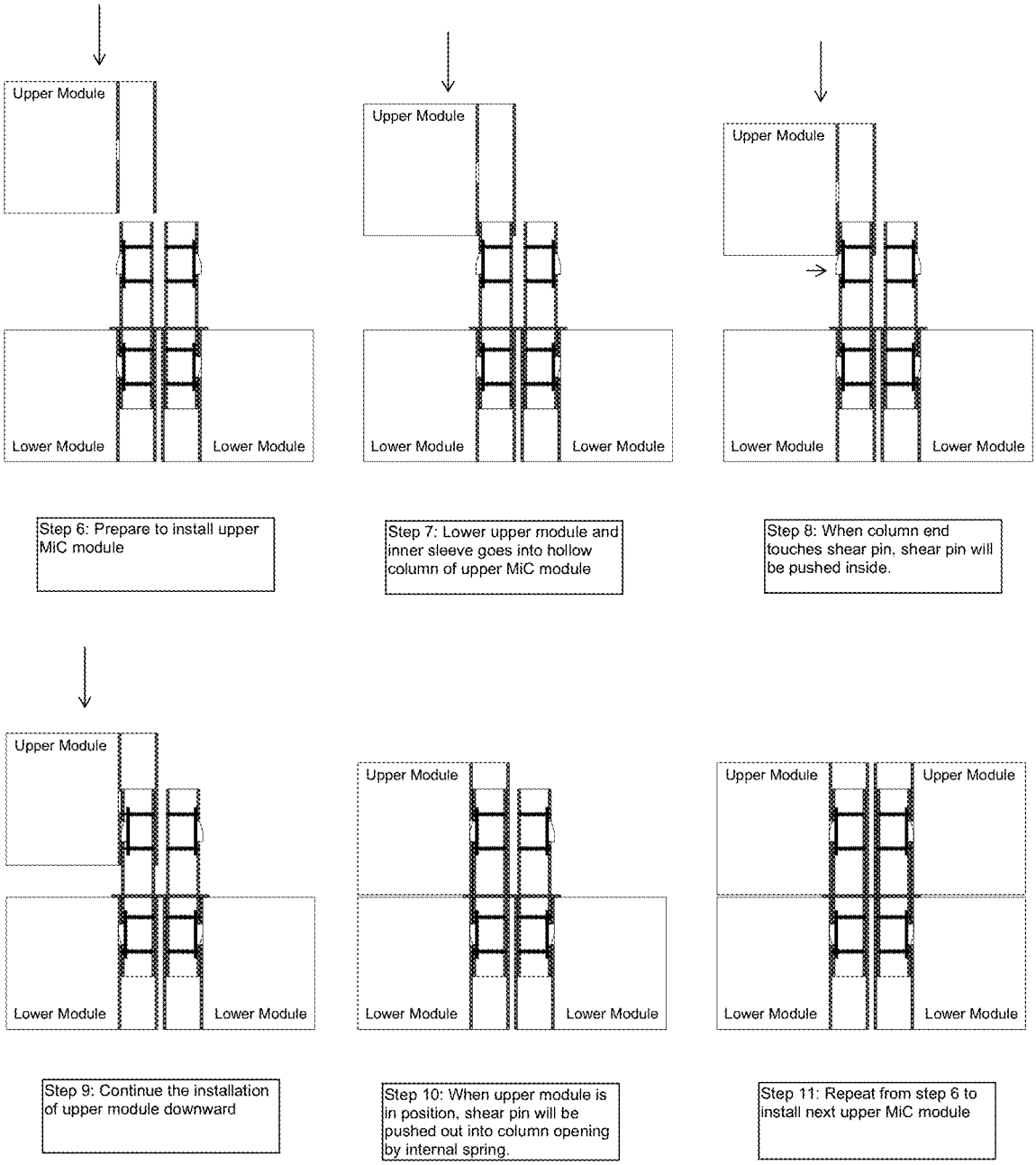

FIGS. 6A-6B depict the assembly of four modules—two lower modules and two upper modules. In FIG. 6A, two lower modules are positioned adjacent to one another. A connection assembly 300 is inserted with inner sleeves in each of the lower module columns such that the latches are first depressed to be flush with the sleeve walls and, when they reach the lower column apertures, project into the aperture through the action of the springs against the latch plate, securing the sleeve assembly to the lower modules.

Turning to FIG. 6B, a first upper module is inserted over the inner sleeve assembly, depressing the latch until the latch engages in the upper module column aperture. Similarly, a second upper module is inserted over the inner sleeve assembly, depressing the latch until the latch reaches the aperture and is engaged within the aperture through the force of the spring. Although only four modules are depicted in FIG. 6B, it is understood that FIGS. 6A and 6B are cross sections; an additional four modules may be positioned behind the four depicted modules for those embodiments that require connections among eight modules as shown in FIG. 1.

Figure 7A:
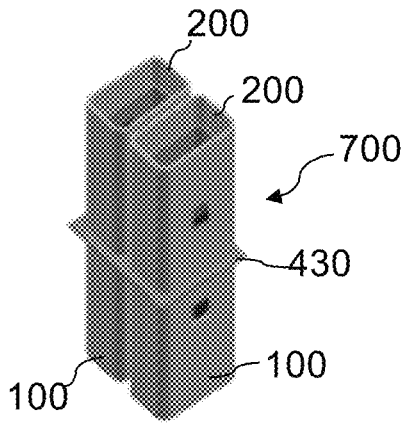
FIG. 7A is perspective view of a four MiC module connection.
Figure 7B:
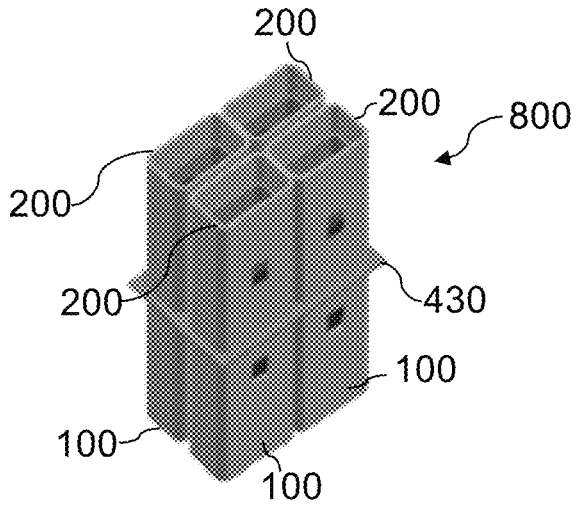
FIG. 7B is perspective view of an eight MiC module connection.

FIGS. 7A and 7B depict assemblies of four modules, 700, and eight modules, 800, respectively. Only the columns involved in the connection are depicted. The two upper columns 200 in FIG. 7A are from adjacent upper modules while the four upper columns 200 in FIG. 7B are from four adjacent upper modules. Similarly, two lower columns 100 are depicted in FIG. 7A and three of four lower columns 100 are shown in FIG. 7B.

The embodiments were chosen and described in order to best explain the principles of the invention and its practical application, thereby enabling others skilled in the art to understand the invention for various embodiments and with various modifications that are suited to the particular use contemplated. It is intended that the scope of the invention be defined by the following claims and their equivalence.

The invention claimed is:

1. A reversible self-locking interconnection system for modular integrated construction comprising:

a first lower steel module defining a portion of a modular building having plural lower module columns, at least a first lower module column including a first lower column receiving aperture;

a first upper steel module defining a portion of a modular building having plural upper module columns, at least a first upper module column including a first upper column receiving aperture;

a first reversible self-locking mechanism interlocking the first upper module column of the first upper steel module to the first lower module column of the first lower steel module, the first self-locking mechanism including:

a horizontal load transfer plate for transferring loads in a horizontal direction;

a first inner sleeve positioned beneath and connected to the horizontal load transfer plate, the first inner sleeve configured and dimensioned to be received within the first lower module column;

a second inner sleeve positioned above and connected to the horizontal load transfer plate, the second inner sleeve configured and dimensioned to be received within the first upper module column;

a first spring-loaded latch positioned within the first inner sleeve for engaging the first lower column receiving aperture;

a second spring-loaded latch positioned within the second inner sleeve for engaging the first upper column receiving aperture;

wherein the first and second spring-loaded latches are recessed within the respective first and second inner sleeves during insertion of the first and second inner sleeves into the lower and upper module columns, the first and second latches engaging with the first and second receiving apertures by respective spring forces when the first upper steel module is positioned and aligned on the first lower steel module and wherein each of the first and second spring-loaded latches comprises a latch plate having a wedge-shaped latch protrusion connecting to a vertical latch surface, the latch plate including one or more latch plate apertures for receiving a rod within a coil spring.

2. The reversible self-locking interconnection system for modular integrated construction according to claim 1, further comprising a second reversible self-locking mechanism interlocking the first upper steel module and the first lower steel module to a building load-bearing support, the second reversible self-locking mechanism comprising:

an angled protrusion extending from the horizontal load transfer plate;

a protrusion-receiving structure embedded in the load-bearing support.

3. The reversible self-locking interconnection system for modular integrated construction according to claim 2, wherein the angled protrusion is an L-shaped plate.

4. The reversible self-locking interconnection system for modular integrated construction according to claim 3, wherein the protrusion-receiving structure includes a base portion embedded in the load-bearing support and an adjustable cover plate forming a plate-receiving slot.

5. The reversible self-locking interconnection system for modular integrated construction according to claim 4, wherein the load-bearing support is a core wall or a core column, or a core beam.

6. The reversible self-locking interconnection system for modular integrated construction according to claim 1, further comprising third and fourth steel modules, the third steel module positioned adjacent the first steel module and the fourth steel module positioned adjacent the second steel module, each of the third and fourth steel modules including columns with receiving apertures positioned therein, and wherein the first reversible self-locking mechanism includes third and fourth inner sleeves positioned adjacent to the first and second inner sleeves with third and fourth spring loaded latches positioned therein for engaging the receiving apertures such that the first reversible self-locking mechanism connects all of the first, second, third, and fourth steel modules.

7. A method for assembling a plurality of modules using the reversible self-locking interconnection system of claim 1, the method comprising:

positioning a lower steel module;

inserting a sleeve assembly comprising an inner sleeve in the lower steel module such that the first latch is first depressed to be flush with the inner sleeve walls and, when the inner sleeve reaches the lower column aperture, projecting into the aperture through the action of springs against the latch plate, thereby securing the sleeve assembly to the lower module;

positioning an upper module over the sleeve assembly secured to the corresponding lower module;

depressing the second latch until the second latch engages in the upper module column aperture of the first upper module.

8. A reversible self-locking interconnection system for modular integrated construction comprising:

first, second, third and fourth lower steel modules, each module defining a portion of a modular building having plural lower module columns, at least one of each lower steel module have a lower module column including a lower column receiving aperture;

first, second, third and fourth upper steel modules, each module defining a portion of a modular building having plural upper module columns, at least one of each upper steel module having an upper module column including an upper column receiving aperture;

a first reversible self-locking mechanism interlocking one upper module column of each of the first, second, third, and fourth upper steel modules to one lower module column of each of the first, second, third, and fourth lower steel modules, the first self-locking mechanism including:

a horizontal load transfer plate for transferring loads in a horizontal direction;

first, second, third, and fourth lower inner sleeves positioned beneath and connected to the horizontal load transfer plate, each lower inner sleeve configured and dimensioned to be received within one of a first, second, third, and fourth lower module columns;

first, second, third, and fourth upper inner sleeves positioned above and connected to the horizontal load transfer plate, the upper inner sleeves configured and dimensioned to be received within one of a first, second, third, and fourth upper module columns;

first spring-loaded latches positioned within each of the lower inner sleeves for engaging lower column receiving apertures;

second spring-loaded latches positioned within each of the upper inner sleeves for engaging upper column receiving apertures;

wherein the first and second spring-loaded latches are recessed within the respective inner sleeves during insertion of the inner sleeves into lower and upper module columns, the first and second latches engaging with the receiving apertures by respective spring forces when the upper steel modules are positioned and aligned on the lower steel modules.

* * * * *